US006059882A

United States Patent [19]

Steinhardt et al.

[11] Patent Number: 6,059,882

[45] Date of Patent: May 9, 2000

[54] APPARATUS FOR DISPENSING TISSUE

[75] Inventors: Mark John Steinhardt; Thomas Alan Wilker; Richard Tweddell, III, all of Cincinnati, Ohio

[73] Assignee: The Procter & Gamble Company, Cincinnati, Ohio

[21] Appl. No.: 09/107,665

[22] Filed: Jun. 30, 1998

[51] Int. Cl.[7] ..... B05C 1/00

[52] U.S. Cl. ..... 118/264

[58] Field of Search ..... 118/264, 268, 118/235, 236; 427/428, 429; 156/578, 534

[56] References Cited

U.S. PATENT DOCUMENTS

| | | | |
|---|---|---|---|
| 3,199,490 | 8/1965 | Karlik | 118/43 |
| 3,707,945 | 1/1973 | Boone | 118/264 |
| 3,865,271 | 2/1975 | Gold | 221/96 |
| 3,910,229 | 10/1975 | Spencer | 118/43 |
| 4,901,889 | 2/1990 | Mitchell | 222/153 |
| 4,991,538 | 2/1991 | Davids et al. | 118/231 |
| 5,311,986 | 5/1994 | Putz | 206/233 |
| 5,618,008 | 4/1997 | Dearwester et al. | 242/594.5 |
| 5,697,577 | 12/1997 | Ogden | 242/598.6 |
| 5,839,608 | 11/1998 | Gillberg-LaForce | 222/1 |
| 5,868,347 | 2/1999 | Paul et al. | 242/596.4 |

FOREIGN PATENT DOCUMENTS

| | | |
|---|---|---|
| 2552764 | 5/1977 | Germany . |
| 2818163 | 10/1979 | Germany . |
| 2912972 | 10/1980 | Germany . |
| WO 93/04622 | 3/1993 | WIPO . |
| WO 98/04177 | 2/1998 | WIPO . |

*Primary Examiner*—Michael W. Ball
*Assistant Examiner*—Michael A Tolin
*Attorney, Agent, or Firm*—Julia A. Glazer; Larry L. Huston; E. Kelly Linman

[57] ABSTRACT

An apparatus for dispensing paper. The apparatus comprises a dispensing system and a moistening system. The moistening system enables a user to optionally moisten the tissue if so desired. The degree to which the tissue is moistened is controlled by the user. The tissue may be dispensed either in roll or sheet form.

25 Claims, 4 Drawing Sheets

APPARATUS FOR DISPENSING TISSUE

FIELD OF THE INVENTION

This invention relates to a new apparatus for dispensing paper. This invention is especially useful for dispensing tissue and toweling. This new apparatus also comprises a moistening system which enables the user to optionally moisten the paper if so desired. The degree of moistening may be controlled by the user.

BACKGROUND OF THE INVENTION

U.S. Pat. No. 4,901,889 issued to Mitchell on Feb. 20, 1990 purports to teach an apparatus for rotatably mounting a roll of tissue in a holder and for dispensing a flowable substance.

U.S. Pat. No. 5,697,577 issued to Ogden on Dec. 16, 1997 purports to teach an apparatus for dispensing a roll of flushable, premoistened tissue paper.

The drawback of these teachings is that the user has no means to control the degree of tissue moistening. Furthermore, the user is only able to utilize tissue which is in roll form.

The benefits of the present invention include enhanced convenience and control for the user. The user controls whether the tissue is used dry or moist. The user also controls the degree to which the tissue is moistened. Furthermore, depending upon the user's preference, the tissue may be dispensed either in roll or sheet form.

SUMMARY OF THE INVENTION

This invention comprises an apparatus for dispensing disposable paper products. In one embodiment the apparatus comprises a casing. The casing includes a reservoir for holding fluid therein. An aperture is disposed on the casing. The aperture interfaces with the reservoir. A membrane having an inner and outer surface is juxtaposed with the aperture. The membrane is in fluid communication with the reservoir such that a disposable paper product placed in contact with the outer surface of the membrane will absorb fluid transferred from the reservoir through the membrane.

The casing which is attachable to a tissue holder may be attached to the tissue holder by two opposed trunions wherein the casing is rotatable about the trunions.

In another embodiment of the invention, the apparatus comprises a casing. The casing has two opposing longitudinal ends. Each of the longitudinal ends is defined by a side wall. Each side wall includes an attachment member and an engaging member. The side walls may optionally be rotatably movable. The side walls may also optionally be detachable from the casing. The casing encloses a reservoir. The reservoir may contain a fluid. An aperture is disposed on the casing. The aperture is interfaced with the reservoir. The apparatus also includes a porous membrane juxtaposed with the aperture such that the membrane is in fluid communication with the reservoir. The membrane may cover the aperture. The membrane may also be removably attached to the casing. The casing may optionally include a fill port.

Alternatively, the membrane may comprise a pouch. The pouch is disposed in the reservoir. Preferably the pores of the pouch are oriented outwardly toward the aperture. The pouch contains a fluid. Preferably the pouch is removable from the reservoir.

In another embodiment of the invention, the apparatus comprises a top wall, a bottom wall, a front wall, a back wall, and opposing side walls all joined together to form a casing. The casing encloses a reservoir. An aperture is disposed on the casing. The aperture is interfaced with the reservoir. A porous membrane is juxtaposed with the aperture. Each of the opposing side walls includes an engaging member and an optional attachment member.

The engaging member may comprise a shelf. The shelf is formed by the back wall extending downwardly to form a downward leg and extending outwardly to form an outward leg. The outward leg is perpendicular to the downward leg. Optionally the front wall and side walls can extend downwardly from the casing to each form a downward leg. The distal end of the downward leg of the front wall and the distal end of the downward legs of the side walls can be connected together to the shelf to form an enclosure. The enclosure can include a dispensing opening.

In another embodiment of the invention, the apparatus comprises a top wall, a bottom wall, a front wall, a back wall, and opposing side walls all joined together to form a casing. Each of the opposing side walls have an engaging member. The engaging member may comprise a shelf. The shelf is formed by the back wall extending downwardly from the casing to form a downward leg and extending outwardly to form an outward leg such that the outward leg is perpendicular to the downward leg.

The opposing side walls may also each include an optional attachment member. A reservoir is enclosed by the casing. An aperture is disposed on the casing. The aperture is interfaced with the reservoir. A pump is disposed on the casing such that the pump contacts the reservoir. The pump includes a compression member and a conduit. The top of the compression member extends outwardly from the casing. The bottom of the compression member is connected to the top of the conduit. The bottom of the conduit contacts the reservoir.

DETAILED DESCRIPTION OF THE INVENTION

The present invention relates to an apparatus 10 utilized for tissue 70 including but not limited to disposable paper products such as toilet paper, facial tissue 70, wipes, and paper toweling. The tissue 70 may be moistened by the user to facilitate cleaning if the user so desires.

The tissue 70 for use with the apparatus of this invention may be made according to commonly assigned U.S. Pat. No. 4,637,859 issued to Trokhan on Jan. 20, 1987; U.S. Pat. No. 4,529,480, issued to Trokhan on Jul. 16, 1985; U.S. Pat. No. 5,364,504 issued to Smurkowski et al. on Nov. 15, 1994; and U.S. Pat. No. 5,529,664, issued to Trokhan et al. on Jun. 25, 1996, the disclosures of which are incorporated herein by reference.

The tissue 70 for use with the apparatus of this invention may include additives such as but not limited to wet strength agents, temporary wet strength agents, and softening agents.

The tissue 70 for use with the apparatus of this invention may be dispensed from a roll such as a roll of toilet paper or dispensed in discrete sheets according to commonly assigned U.S. Pat. No. 4,623,074 issued to Dearwester on Nov. 18, 1986; U.S. Pat. No. 5,332,118 issued to Muckenfuhs on Jul. 26, 1994; U.S. Pat. No. 5,379,897 issued to Muckenfuhs et al. on Jan. 10, 1995; U.S. Pat. No. 5,516,001 issued to Muckenfuhs et al. on May 14, 1996; and U.S. Pat. No. 5,520,308 issued to Berg, Jr. et al. on May 28, 1996, all of which are incorporated herein by reference.

Figure 1:
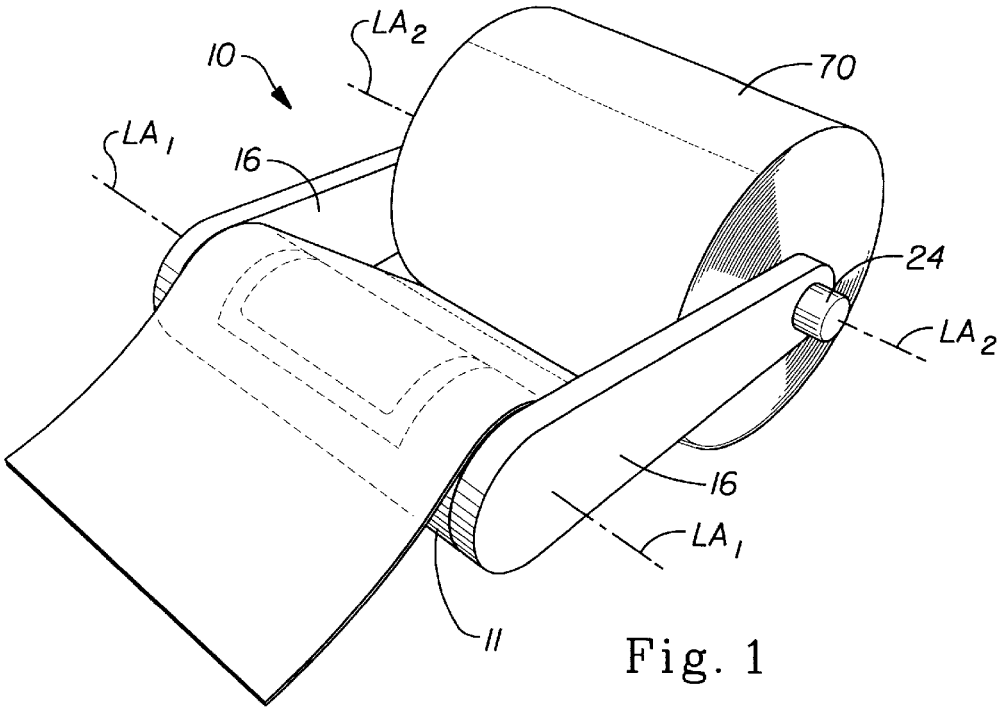
FIG. 1 is a perspective view of an apparatus according to the present invention.
Figure 2A:
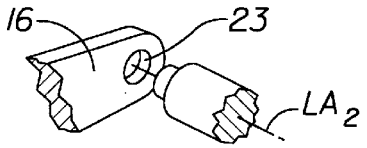
FIG. 2A is a fragmentary perspective view of the attachment member and engaging member of FIG. 2.
Figure 2:
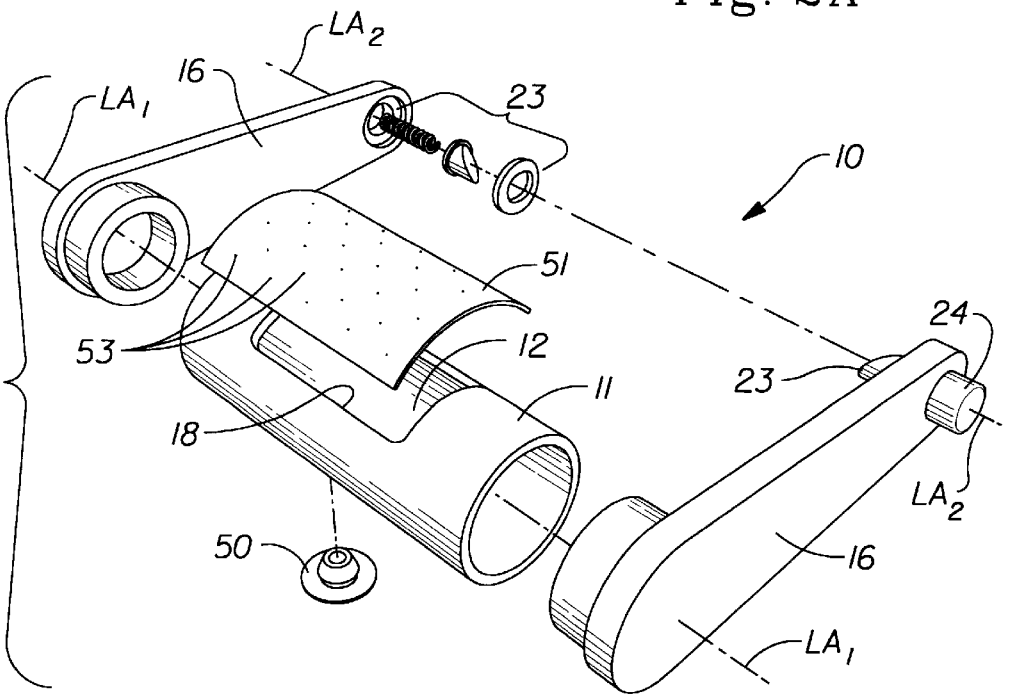
FIG. 2 is an exploded perspective view of the apparatus of FIG. 1

Referring now to the drawings in detail wherein the numerals indicate the same element throughout the views, FIG. 1 illustrates a perspective view of one embodiment of the present invention. The apparatus 10 is comprised of a casing 11. The casing 11 may be of any shape but is preferably cylindrical such that it rotates about its longitudinal axis $LA_1$. The longitudinal axis of the casing 11 can be either horizontal or vertical. Each of the two longitudinal ends of the casing 11 are defined by side walls 16. As shown in FIGS. 1 and 2, the casing 11 is also rotatable about a second longitudinal axis $LA_2$. The second longitudinal axis $LA_2$ is colinear to the engaging member 23 and the attachment member 24.

The side walls 16 of the casing 11 may be attached to a tissue holder. For example, the casing 11 may be attached to a tissue holder by two opposed trunions (not shown) whereby the casing 11 is rotatable about the trunions. The side walls 16 of the casing 11 may be non-removably attached or preferably removably attached as shown in FIG. 2. Referring to FIGS. 1 and 2, the side walls 16 may also extend upwardly, downwardly, or both from the casing 11. It would be apparent to one skilled in the art that instead of the side walls 16 extending upwardly or downwardly, a separate side arm (not shown) extending upwardly or downwardly, could be attached to each side wall 16.

The side walls 16 may be fixed in place or preferably are rotatable about the casing 11. It is preferred that each side wall 16 be capable of rotating about the axis of the casing 11 at least about 110°, more preferably, at least about 180°, and most preferably about 360°.

The apparatus 10 may be a stand alone apparatus 10 or it may be attached to an existing tissue roll holder in a secured and substantially fixed position. The tissue roll holder is then attached to a wall or other rigid mounting surface without the need for adhesives or the like. As used herein, the term "adhesives" designates substances that bond two materials together by adhering to the surface of each, such as glue, starch paste, mucilage, rubber latex, a synthetic resin composition, cement, adhesive tape, and the like. Because toilet tissue roll holders often extend out from a bathroom wall or are recessed within the wall, the apparatus 10 is more versatile if attachable to a wide range of such holders. As used herein, the terms "an ordinary wall mounted toilet tissue roll holder", "a toilet tissue roll holder", "a tissue roll holder", or simply "a holder", are used interchangeably and designate a conventional holder for a roll of toilet paper, paper toweling, or similar material whether it is a holder extending out from a wall or a holder recessed within a wall.

Referring to FIGS. 1 and 2, each side wall 16 includes an attachment member 24. The attachment members 24 may be used to attach the apparatus 10 to an existing tissue roll holder. The attachment members 24 may include opposing posts, slots, (not shown) or any other suitable device which would be apparent to one skilled in the art, such as those described in commonly assigned U.S. Pat. No. 5,618,008 issued to Dearwester et al. on Apr. 8, 1997 and incorporated herein by reference.

Each side wall 16 also includes an engaging member 23 for receiving at least one roll of tissue 70. As described herein, "engaging member(s)" 23 refers to any device useful for containing or holding rolls of tissue 70 or discrete sheets of tissue 70. For containing rolls of tissue 70, the engaging members 23 can be opposing slots (not shown) or holes such as shown in FIG. 2A. Each hole is adapted to receive a spindle having a roll of tissue 70 disposed thereon. The engaging members 23 may also comprise co-extending protuberances as shown in FIG. 2. The co-extending protuberances preferably project towards each other and may or may not touch each other. Each pair of protuberances is adapted to receive a roll of toilet tissue 70. The engaging members 23 may include other suitable devices which would be apparent to one skilled in the art including those described in U.S. Pat. No. 5,618,008 issued to Dearwester et al. on Apr. 8, 1997 and incorporated herein by reference.

Another embodiment of the present invention is shown in FIGS. 3–9. Referring to FIGS. 3–7, the apparatus 10 is comprised of a top wall 13, a bottom wall, a front wall 14, a back wall 15 and opposing side walls 16 all joined together to form a casing 11. The apparatus 10 may be a stand alone apparatus 10 or it may be attached to an existing tissue roll holder in a secured and substantially fixed position without the need for adhesives or the like. The tissue roll holder is then attached to a wall or other rigid mounting surface.

Each side wall 16 may include an attachment member 24. The attachment member 24 may include opposing posts, slots, or any other suitable device which would be apparent to one skilled in the art. Non-limiting examples of other suitable devices are found in commonly assigned U.S. Pat. No. 5,618,008 issued to Dearwester et al. on Apr. 8, 1997 incorporated herein by reference.

Figure 7:
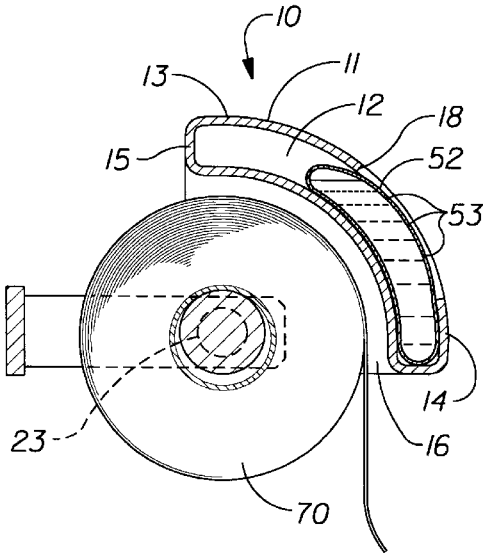
FIG. 7 is a vertical sectional view similar to FIG. 6.
Figure 8:
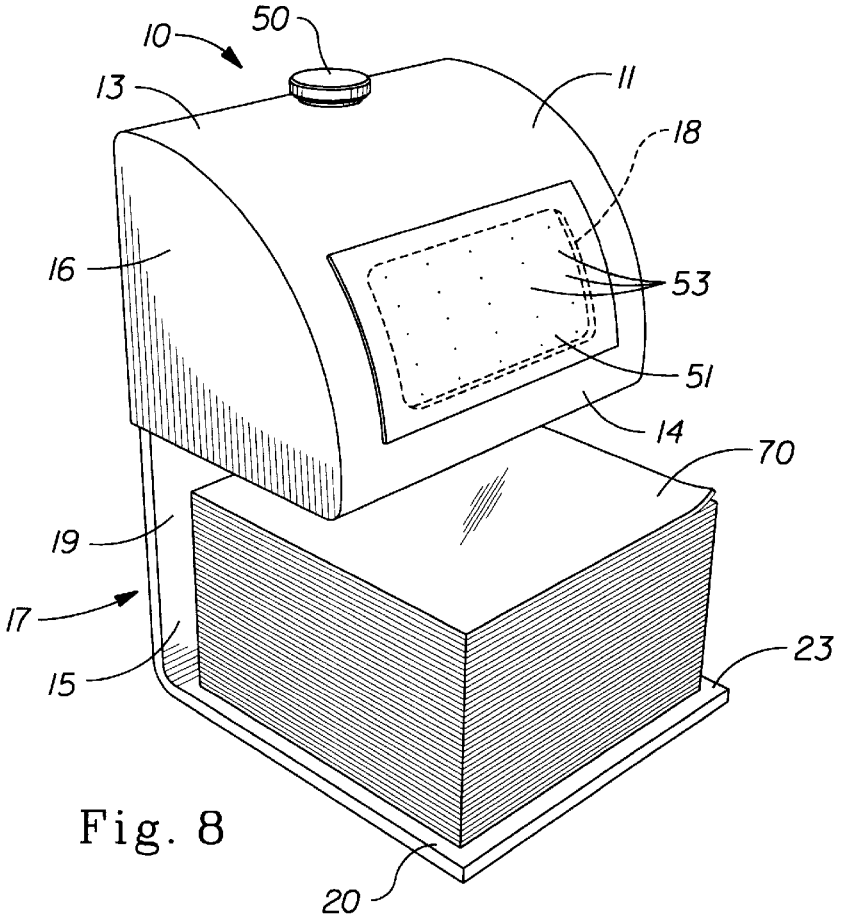
FIG. 8 is a perspective view of the apparatus of FIG. 5 illustrating an optional shelf for holding sheets of tissue.

Each side wall 16 also includes an engaging member 23 for receiving discrete sheets of tissue 70 or at least one roll of tissue 70. For dispensing rolls of tissue 70, the engaging members 23 can be opposing slots, protuberances or holes (not shown) wherein each hole is adapted to receive a spindle having a roll of tissue 70 disposed thereon. For dispensing discrete sheets of tissue 70, the engaging member 23 can be a shelf 17 as shown in FIG. 8 or any other suitable means familiar to one of skill in the art suitable for containing discreet sheets of tissue 70. Referring to FIG. 8, the shelf 17 may be formed by the back wall 15 of the casing 11 of FIGS. 3–7 wherein the back wall 15 extends in a downward direction from the casing 11 to form a downward leg 19 and extends in an outward direction to form an outward leg 20 perpendicular to the downward leg 19.

Figure 9:
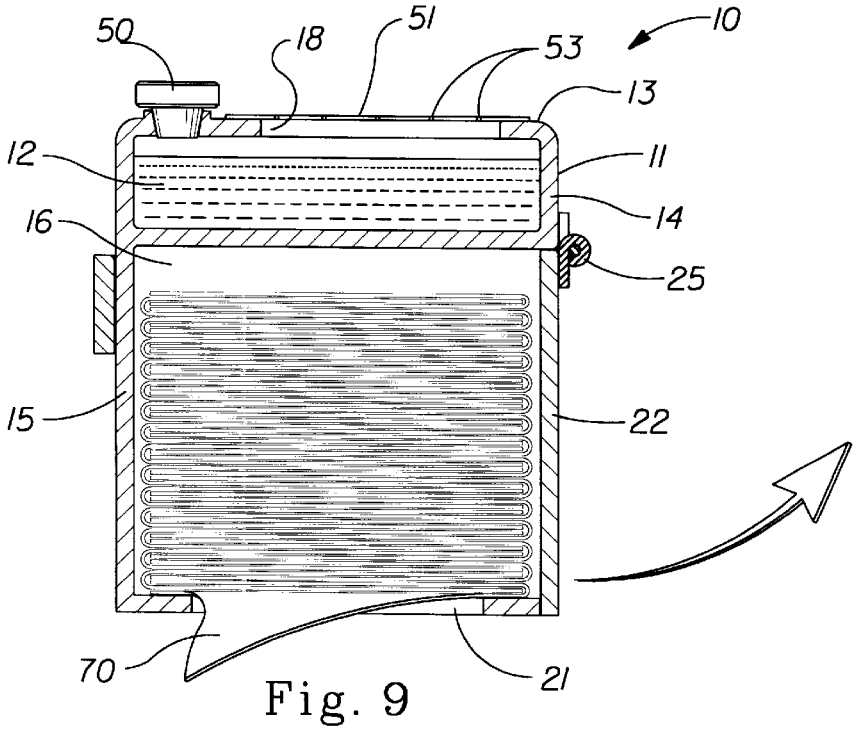
FIG. 9 is a vertical sectional view of a fourth embodiment of an apparatus according to the present invention.

Alternatively, the engaging member 23 could be an enclosure 22 as illustrated in FIG. 9 useful for containing discrete sheets of tissue 70. Non-limiting examples of discrete sheets of tissue 70 include, facial tissue 70, toilet tissue 70, and wipes. The enclosure 22 of FIG. 9 is formed by the shelf 17 of FIG. 8 and the front wall 14 and side walls 16 of the casing 11 of FIGS. 5–7 wherein the front wall 14 and the side walls 16 extend in a downward direction from the casing 11 each forming a downward leg. The distal ends of the downward legs of the front wall 14 and the side walls 16 connect to the shelf 17 to form an enclosure 22.

The front wall 14 (or any other wall) may be hingedly attached to the enclosure 22 with a hinge 25 or any similar device as illustrated in FIG. 9 such that the hingedly attached wall 14 may be opened to permit access to the inside of the enclosure 22. The enclosure 22 also includes a dispensing opening 21 preferably located at the bottom of the enclosure 22 so as to permit a user to withdraw tissue 70 sheets through the dispensing opening 21. In addition to the types of engaging members 23 illustrated here, it would be obvious to one of skill in the art that other devices may be used as suitable engaging members 23.

Though the casing 11 of the present invention may be made out of any suitable material familiar to one of skill in the art, molded plastic material is preferred.

Referring to FIGS. 2, 4, 6–7, and 9, the casing 11 encloses a reservoir 12. The reservoir 12 holds a fluid. The reservoir 12 is designed such that the fluid can be placed directly into the reservoir 12. Alternatively, a container capable of holding a fluid, can be placed into the reservoir 12. The apparatus 10 is either received by the user with the reservoir 12 prefilled or the reservoir 12 can be filled by the user.

Fluids useful with the present invention may be aqueous or non-aqueous based. A non-inclusive list of fluids suitable with the present invention includes lotions, petrolatum, ointments, and personal cleansing products such as those disclosed in commonly assigned U.S. Pat. No. 5,332,118 issued to Muckenfuhs on Jul. 26, 1994 and U.S. Pat. No. 5,525,345 issued to Warner et al. on Nov. 11, 1996, the disclosures of which are incorporated herein by reference.

The casing 11 of the apparatus 10 may also include a fill port 50 as shown in FIGS. 2, 5–6, and 8–9. As used herein, "fill port 50" refers to an orifice and closure wherein a user can access the reservoir 12 from the exterior of the casing 11 for purposes of filling the reservoir 12 with a fluid. Any type closure familiar to one of skill in the art may be used for this purpose as long as the closure is capable of creating a water tight seal at the intersection of the closure with the casing 11.

An aperture 18 is disposed on the casing 11 such that the aperture 18 is interfaced with the reservoir 12 as illustrated in FIGS. 2, and 5–7. The aperture 18 which is preferably oriented toward the user is at least about 0.25 inches long by 0.25 inches wide.

In one embodiment a membrane 51 is disposed on the casing 11. The membrane 51 which has an inner and outer surface is juxtaposed with the aperture 18 as illustrated in FIGS. 1, 2, 6–7, and 9. The membrane 51 is in fluid communication with the reservoir 12. The membrane 51 contains pores 53. These pores 53 preferably remain closed until the membrane 51 is depressed by a user. Upon deflection of the membrane 51, the pores 53 of the membrane 51 open permitting the transfer of fluid from the reservoir 12 through the pores 53 of the membrane 51. When the deflection force is released, the pores 53 of the membrane 51 reclose thereby preventing further release of fluid. A membrane 51 which transfers fluid osmotically is considered to have pores 53 within the meaning of the claimed invention.

The amount of fluid released during a single deflection of the membrane 51 is dictated by the number of pores 53, the pore 53 size, the amount of deflection force applied to the membrane 51 by the user, and the length of time that the deflection force is applied to the membrane 51. In operation, a user places tissue 70 on the outer surface of the membrane 51 by unwinding it from the roll or by placing a discrete sheet on the membrane 51. The user then deflects the tissue 70 against the membrane 51, thereby initiating the transfer of fluid from the reservoir 12 through the pores 53 of the membrane 51 to the tissue 70. Preferably the membrane 51 has sufficient resistance to water vapor diffusion to prevent undue evaporation of the fluid from the reservoir 12.

In one embodiment, the membrane 51 is attached to the casing 11 such that the membrane 51 preferably completely covers the aperture 18 as illustrated in FIGS. 2, 5, 6, and 8. The membrane 51 is attached to the casing 11 in a substantially relaxed state. As used herein, "substantially relaxed state" refers to an elastic material which is in a state of rest wherein the elastic material is at equilibrium. The membrane 51 may be permanently attached to the casing 11 or prophetically removably attached whereby the user can remove the membrane 51 and then reapply the same membrane 51 or a new membrane 51 to the casing 11. The removable membrane 51 also provides the user access to the reservoir 12 for purposes of filling or refilling the reservoir 12 with fluid.

The membrane 51 may be attached to the casing 11 by any attachment means suitable to create a water tight seal at the interface of the membrane 51 and the casing 11. For example, the membrane 51 may be adhesively attached to the casing 11, using a double stick adhesive tape. A suitable double stick adhesive tape is available as double stick adhesive tape item No. 2530 from W.J. Dennis and Company of Elgin, Ill.

In another embodiment, the membrane 51 is integral with a container capable of holding a fluid. The container can be a pouch 52. The pouch may be a flaccid bladder or rigid. As illustrated in FIG. 7, the pouch 52 is disposed in the reservoir 12. Preferably, the pouch 52 is not attached to the reservoir 12 or casing 11 and hence may be freely moved in or out of the reservoir 12. Preferably the pouch 52 is oriented in the reservoir 12 such that the pores 53 of the pouch 52 face outwardly 20 towards the user. The pouch 52 is either prefilled with fluid or the user fills the pouch 52 with fluid. The pouch 52 is preferably resealable such that it can be opened and closed by the user. This allows the user to fill and reuse the pouch 52 upon depletion of the fluid in the pouch 52 without necessitating procurement of a new pouch 52. Upon deflection of the pouch 52 by a user, fluid is expelled from the pouch 52 through the pores 53.

The membrane 51 may be constructed from any deformable, compressible material including but not limited to sponge, foam, liquid pervious barrier material and preferably pervious elastic material. Elastic materials suitable for use with the present invention include but are not limited to, polyester films, formed film top sheets such as disclosed in commonly assigned U.S. Pat. No. 4,342,314 issued to Radel et al. on Aug. 3, 1982 and U.S. Pat No. 4,463,045 issued to Ahr et al. on Jul. 31, 1984, the disclosures of which are incorporated herein by reference, and preferably latex sheeting.

The preferred latex sheeting will have a thickness of about 4 mils to 100 mils, more preferably about 6 mils to 50 mils, and most preferably about 8 mils to 20 mils; a tensile strength of about 3000 psi to 9000 psi; an ultimate elongation of about 500% to 1000%; a Shore A durometer hardness of about 35 to 90; a specific gravity of about 0.930 to 1.15; and an operating temperature range of about −53° C. to 82° C. A preferred latex sheeting is commercially sold as HYTONE™ available from The Hygenic Corporation of Akron, Ohio.

The total number of pores 53 and pore 53 size of a membrane 51 can be any combination of the two which upon depression of the membrane 51 by a user, allows transfer of fluid through the pores 53 of the membrane 51 to the tissue 70. Non-limiting examples are presented herewith for purposes of illustrating how to prepare a membrane 51 and a pouch 52 for use with the present invention:

EXAMPLE 1

Preparation of Membrane

A membrane 51 was prepared by cutting a single sheet of HYTONE™ latex sheeting having a gauge of 0.010 inches to a length and width slightly larger than the perimeter of the aperture 18 such that the total area of the membrane 51 was greater than the total area of the aperture 18. For this example, the latex sheeting extended beyond the aperture 18 by 0.125 inches on all four sides.

For purposes of this example, the latex sheeting was cut to a length of 2.5 inches and a width of 1.5 inches. To form the pores 53, the latex sheeting may either remain unstretched in the longitudinal direction or prophetically may be preferably stretched in the longitudinal direction to a length of about two to four times its unstretched length. In this example and example 2 below, the pores 53 were formed on unstretched latex sheeting.

Using an X-ACTO® knife, slits were cut into the latex sheeting using the tip of the X-ACTO® knife blade. Each slit had a length of 1 mm. Slits were cut into the HYTONE™ latex sheeting every 0.25 inches so as to create a membrane 51 having five rows of pores 53, each row comprised of nine pores 53 for a total of forty-five pores 53.

Double-stick adhesive tape 0.5 inches in width was applied to the perimeter of the casing 11 surrounding the aperture 18. The membrane 51 was then adhesively attached to the double stick adhesive tape around the perimeter of the casing 11 so as to completely cover the aperture 18.

EXAMPLE 2

Preparation of Pouch Membrane

To prepare a membrane 51 comprised of a pouch 52, two pieces of HYTONE™ latex sheeting were each cut to a length of 3.75 inches and a width of 2.25 inches.

Using an X-ACTO® knife, slits were cut into the latex sheeting using the tip of the X-ACTO® knife blade. Each slit had a length of 1 mm. Slits were cut into the HYTONE™ latex sheeting every 0.5 inches so as to create a membrane 51 having six rows of pores 53, with four pores 53 per row for a total of twenty-four pores 53.

Double-stick tape was applied to the entire length of the two longitudinal edges of the membrane 51 and to the entire width of one lateral edge of the membrane 51. The second piece of latex sheeting was then placed on top of the membrane 51 such that the taped edges of the membrane 51 were in alignment with and contacting the two longitudinal edges and one lateral edge of the second piece of latex sheeting. The membrane 51 and second piece of latex sheeting were then pressed firmly together to form a pouch 52 having three sealed sides.

A strip of double-stick tape was then positioned halfway around the inside perimeter of the open side of the pouch 52 along the lateral edge. The pouch 52 was filled with fluid to a level just below the proximal edge of the double-stick tape. The pouch 52 was then closed by pressing the open sides of the pouch 52 firmly together.

One of skill in the art would recognize that in preparing the membrane 51 or the pouch 52, the size of the membrane 51 or pouch 52, the number of pores 53, dimension of each pore 53, and configuration of the pores 53 could be varied without departing from the scope and spirit of this invention. One of skill in the art would also recognize that there are other means by which to seal the pouch 52 including but not limited to mechanically sealing, heat sealing, adhesively sealing the pouch 52 by hot melt glue application, and using self-adhesive techniques such as disclosed in commonly assigned U.S. Pat. No. 5,662,758 issued to Hamilton et al. on Sep. 2, 1997 the disclosure of which is incorporated herein by reference.

Figure 3:
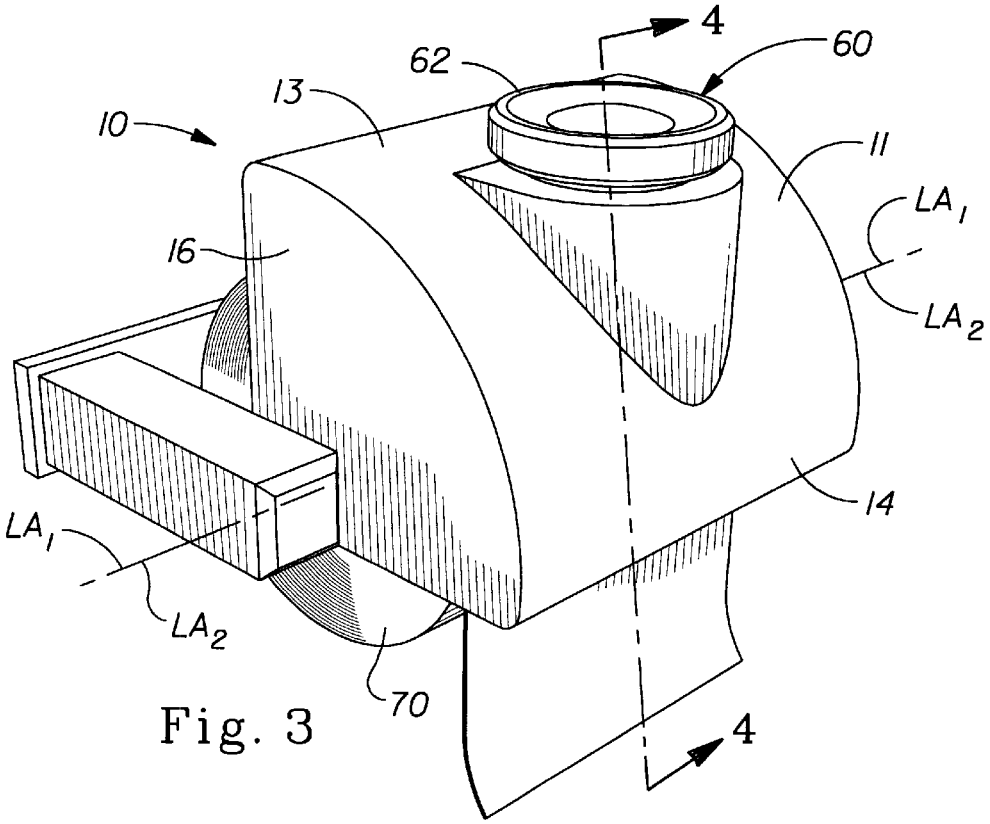
FIG. 3 is a perspective view of a second embodiment of an apparatus according to the present invention.
Figure 4:
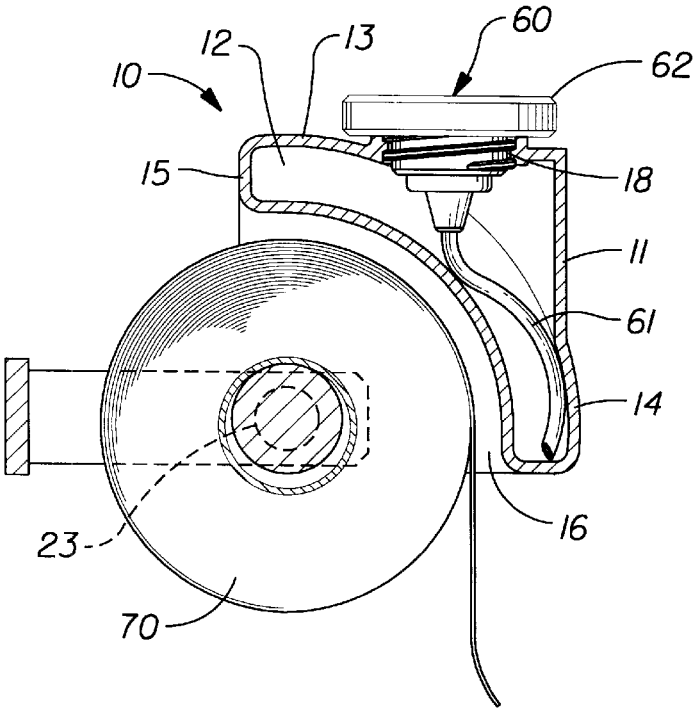
FIG. 4 is a vertical sectional view taken along lines 4—4 of the apparatus of the apparatus of FIG. 3.
Figure 5:
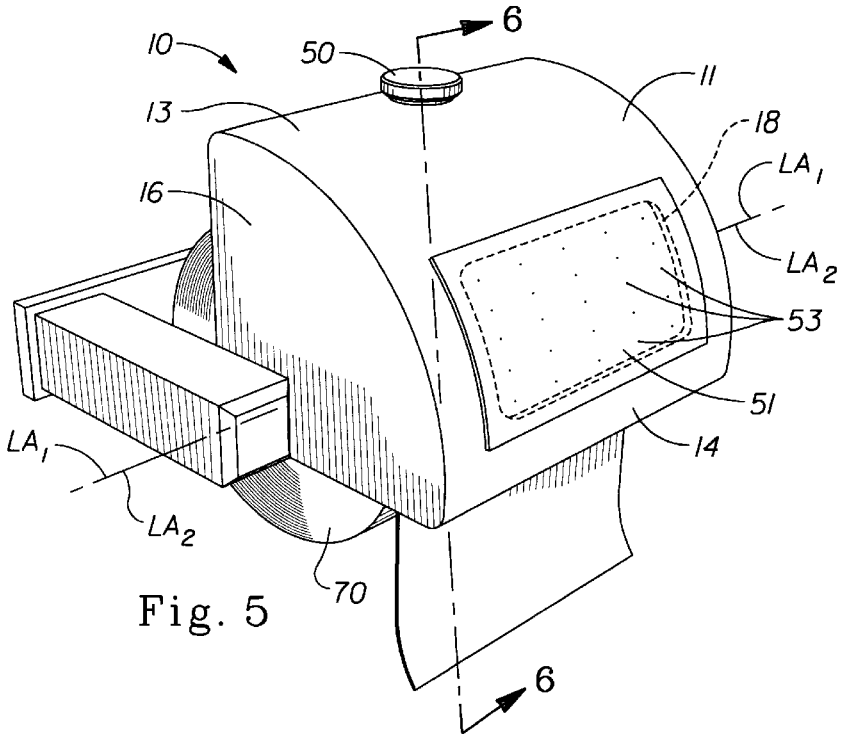
FIG. 5 is a perspective view of a third embodiment of an apparatus according to the present invention.
Figure 6:
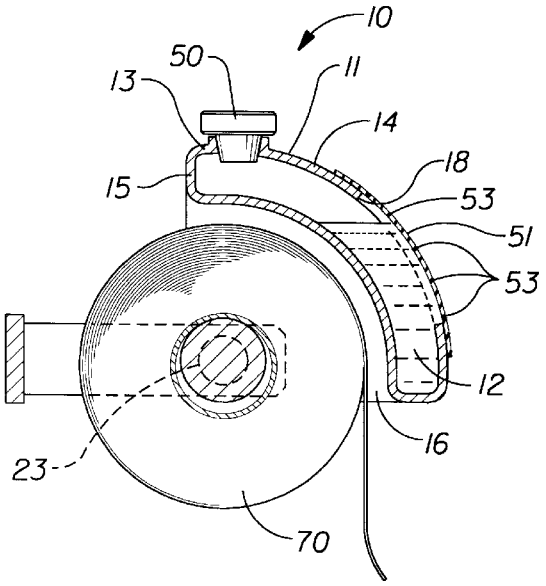
FIG. 6 is a vertical sectional view taken along lines 6—6 of FIG. 5.

In another embodiment of the present invention, a pump 60 is used instead of a membrane 51 to transfer fluid from the reservoir 12 to the user as illustrated in FIGS. 3 and 4. The pump 60 is comprised of a compression member 62 having a top and a bottom and a conduit 61 having a top and bottom. The compression member 62 is connected to the casing 11. The compression member 62 is preferably aligned with the aperture 18 such that the compression member 62 is interfaced with the aperture 18 and the reservoir 12. Preferably the top of the compression member 62 extends outwardly from the casing 11.

The bottom of the compression member 62 is connected to the top of the conduit 61. The bottom of the conduit 61 contacts the reservoir 12. The conduit 61 may be comprised of any type material suitable for conducting a fluid including but not limited to flexible tubing.

A preferred pump 60 is the One-Touch Stainless Steel Pump 60, item No. 3300 available from Menda Scientific of Santa Barbara, Calif.

In use, a user would place tissue 70 against the top of the compression member 62. Upon depressing the tissue 70 against the compression member 62 by the user, fluid is withdrawn from the reservoir 12 and conducted through the conduit 61 to the top of the compression member 62 where it is transferred to the tissue 70. The preferred pump 60 of this invention dispenses about 0.5 cc of fluid per compression of the pump by the user.

While particular embodiments of the invention have been illustrated and described, it would be obvious to those skilled in the art that various changes and modifications can be made without departing from the scope and spirit of the invention.

What is claimed is:

1. An apparatus for dispensing disposable paper products, said apparatus comprising:

a) a casing, said casing being attachable to a tissue holder, having a reservoir for containing fluid therein;

b) an aperture disposed on said casing, said aperture interfacing with said reservoir;

c) a membrane having an inner and outer surface, said membrane juxtaposed with said aperture, said membrane being in fluid communication with said reservoir, whereby a disposable paper product may be placed in contact with said outer surface of said membrane and absorb fluid transferred from said reservoir through said membrane.

2. An apparatus according to claim 1 wherein said casing is attachable to said tissue holder by two opposed trunions, said casing being rotatable about said trunions.

3. An apparatus for dispensing disposable paper products, said apparatus comprising:

a) a casing, having two opposing longitudinal ends each defined by a side wall, said side walls including an attachment member and an engaging member;

b) a reservoir enclosed by said casing;

c) an aperture disposed on said casing, wherein said aperture is interfaced with said reservoir;

d) a membrane, said membrane having pores, said membrane juxtaposed with said aperture.

4. The apparatus of claim 3 wherein said side walls are rotatably movable.

5. The apparatus of claim 4 wherein said side walls are detachable from said casing.

6. The apparatus of claim 5 wherein said reservoir contains a fluid.

7. The apparatus of claim 3 wherein said membrane is removably attached to said casing.

8. The apparatus of claim 3 wherein said membrane covers said aperture.

9. The apparatus of claim 3 wherein said membrane comprises a pouch, said pouch disposed in said reservoir.

10. The apparatus of claim 9 wherein the pores of said pouch are oriented outwardly toward said aperture.

11. The apparatus of claim 9 wherein said pouch contains a fluid.

12. The apparatus of claim 11 wherein said pouch is removable from said reservoir.

13. The apparatus of claim 3 wherein said casing further comprises a fill port.

14. An apparatus for dispensing paper, said apparatus comprising:

(a) a top wall, a bottom wall, a front wall, a back wall, and opposing side walls all joined together to form a casing, each of said opposing side walls having an engaging member;

(b) a reservoir enclosed by said casing;

(c) an aperture disposed on said casing wherein said aperture is interfaced with said reservoir; and d) a membrane, said membrane having pores, said membrane juxtaposed with said aperture.

15. The apparatus of claim 14 wherein said reservoir contains a fluid.

16. The apparatus of claim 15 wherein said casing further comprises a fill port.

17. The apparatus of claim 14 wherein said membrane comprises a pouch disposed in said reservoir.

18. The apparatus of claim 17 wherein the pores of said pouch are oriented outwardly toward said aperture.

19. The apparatus of claim 17 wherein said pouch contains a fluid.

20. The apparatus of claim 19 wherein said pouch is removable from said casing.

21. The apparatus of claim 14 wherein said engaging member comprises a shelf formed by said back wall extending downwardly to form a downward leg and extending outwardly to form an outward leg wherein said outward leg is perpendicular to said downward leg.

22. The apparatus of claim 21 wherein said front wall and said side walls extend downwardly from said casing, said front wall and said side walls each forming a downward leg, the distal end of said downward leg of said front wall and the distal ends of said downward legs of said side walls connecting to said shelf so as to form an enclosure, said front wall hingedly attached to said enclosure, said enclosure including a dispensing opening.

23. The apparatus of claim 14 further comprising an attachment member.

24. The apparatus of claim 14 wherein said membrane is removably attached to said casing.

25. The apparatus of claim 14 wherein said membrane covers said aperture.

* * * * *